US005438920A

United States Patent [19]

Koivukunnas et al.

[11] Patent Number: 5,438,920

[45] Date of Patent: Aug. 8, 1995

[54] METHOD FOR CALENDERING A PAPER OR AN EQUIVALENT WEB MATERIAL AND A CALENDER THAT MAKES USE OF THE METHOD

[75] Inventors: Pekka Koivukunnas; Juha Lipponen, both of Järvenpää , Finland

[73] Assignee: Valmet Paper Machinery Inc., Helsinki, Finland

[21] Appl. No.: 168,521

[22] Filed: Dec. 16, 1993

[30] Foreign Application Priority Data

Nov. 24, 1993 [FI] Finland ..... FI 935214

[51] Int. Cl.[6] ..... B30B 3/04; D21G 1/00

[52] U.S. Cl. ..... 100/38; 100/93 RP; 100/162 B; 100/163 A

[58] Field of Search ..... 100/35, 38, 47, 161, 100/162 R, 162 B, 163 R, 163 A, 93 RP

[56] References Cited

U.S. PATENT DOCUMENTS

| | | | |
|---|---|---|---|
| 4,480,537 | 11/1984 | Agronin et al. | 100/38 |
| 4,823,690 | 4/1989 | Stotz | 100/163 A |
| 4,901,637 | 2/1990 | Hagel et al. | 100/170 |
| 4,924,772 | 5/1990 | Schlunke et al. | 100/163 R |
| 4,936,207 | 6/1990 | Niskanen et al. | 100/47 |
| 4,986,883 | 1/1991 | Taipale et al. | 162/205 |
| 4,991,499 | 2/1991 | Küsters | 100/47 |
| 5,029,521 | 7/1991 | Pav et al. | 100/38 |
| 5,038,678 | 8/1991 | Honkala et al. | 100/170 |
| 5,179,894 | 1/1993 | Hinz et al. | 100/163 A |
| 5,226,357 | 7/1993 | Schiel | 100/47 |

FOREIGN PATENT DOCUMENTS 2237584 5/1991 United Kingdom .

OTHER PUBLICATIONS

"New Generation of Supercalenders", G. Stotz and W. Schuwerk, Tappi Journal, Jul. 1989, pp. 95–102.

*Primary Examiner*—Stephen F. Gerrity
*Attorney, Agent, or Firm*—Steinberg, Raskin & Davidson

[57] ABSTRACT

A method and device for calendering of a paper or an equivalent web material, in which the web material to be calendered is passed through nips formed by a variable-crown upper roll, a variable-crown lower roll, and by two or more intermediate rolls arranged between the upper and lower rolls. The upper roll, lower roll, and intermediate rolls are arranged as a substantially vertical stack of rolls. As the intermediate rolls, rolls are used in which the form of the natural deflection line produced by their own gravity is substantially equal. The nip load produced by the masses of the intermediate rolls and the auxiliary equipment related to the intermediate rolls is substantially relieved, and almost even completely relieved. An adjustable load is applied to the calendering nips by the variable-crown upper roll or lower roll and/or by an external load applied to the upper or lower roll.

26 Claims, 6 Drawing Sheets

METHOD FOR CALENDERING A PAPER OR AN EQUIVALENT WEB MATERIAL AND A CALENDER THAT MAKES USE OF THE METHOD

BACKGROUND OF THE INVENTION

The present invention relates to a method for calendering a paper web or an equivalent web material in a calender, wherein the web material to be calendered is passed through nips formed by a variable-crown upper roll, a variable-crown lower roll, and by intermediate rolls arranged between the upper and lower rolls. The rolls are arranged as a substantially vertical stack of rolls.

The invention also relates to a calender that makes use of the method, and includes a variable-crown upper roll, a variable-crown lower roll, and a number of intermediate rolls arranged between the upper and lower rolls. The upper roll, lower roll and intermediate rolls are arranged on the frame of the calender as a substantially vertical stack of rolls whereby the rolls are placed one above the other, and such that calendering nips are formed between adjacent rolls.

The set of rolls in a conventional supercalender device comprises a number of rolls arranged one above the other to form a stack, i.e., as a stack of rolls. Adjacent rolls, placed one above the other, are in nip contact with each another, and the paper or board web, or equivalent web material to be calendered, is arranged to run through the nips between the rolls. The rolls in the set of rolls are journalled revolvingly on bearing housings which are typically attached to base parts. The base parts are arranged slidably on vertical guides provided in the frame of the calender. Further, the base parts are provided with backup parts arranged on vertical lifting spindles situated in the frame of the calender. One particular function of the lifting spindles is to act as guides in order to keep the rolls in the set of rolls in the correct position. The bearing housings of the rolls in the set of rolls are not fixed rigidly to the frame of the calender. Thus, the bearing housings and the rolls can move in a vertical direction.

Since the combined mass of the bearing housings of the rolls and the auxiliary equipment attached to the bearing housings are quite large, in conventional supercalenders this weight produces a significant drawback in that the combined mass of the bearing housings and the auxiliary equipment attached to the bearing housings produce distortions in the distributions of the linear loads in the nips. Thus, the linear load is not uniform in the nips, but rather there is a considerable deviation in the profile of the desired and applied linear loads at the ends of the nips.

Since a number of rolls are placed one above the other in the sets of rolls in conventional supercalenders, as discussed above, this has the further consequence that the deviated linear loads in the individual nips are cumulative and produce a considerably large error in the overall linear load. This defective distribution of linear load deteriorates the quality of the calendered paper or equivalent web material.

One prior art device intended to resolve the problem stated above is described in the assignee's Finnish Patent No. FI 81,633 (corresponding to U.S. Pat. No. 4,901,637, the specification of which is hereby incorporated by reference herein), wherein the set of rolls is provided with relief means supported on the base parts of the rolls, on one hand, and on spindle nuts provided on the lifting spindle, on the other hand. In this manner, the relief means substantially eliminate distortions arising from the weight of the bearing housings of the rolls and the auxiliary equipment attached to same, e.g., the take-out leading rolls, in the lateral areas of the profiles of linear loads between the rolls. Also, in conventional machine calenders, a device is known in the prior art in which the rolls of the machine calender are provided with a relief system, in particular with hydraulic relief cylinders, in order to eliminate the point loads arising from the bearing housings of rolls and from their auxiliary equipment.

In machine calenders, it is easy to provide such relief means, because the rolls in the set of rolls in a machine calender are arranged by means of linkages mounted on the frame of the calender. However, the use of devices corresponding to those of machine calenders in supercalenders is quite difficult because of the constantly varying diameters of the fiber rolls and because of the high number of rolls.

Owing to the conventional construction described above, another significant drawback of conventional supercalenders relates to the vertical movements of the rolls in the set of rolls. As described above, the bearing housings of the rolls in the set of rolls are mounted on base parts which move vertically along the guides provided in the frame of the calender. This second drawback stems from the friction at the guides which is effective between the guides and the base parts.

As a result of the friction at the guides, the rolls in the set of rolls cannot move freely to be positioned vertically in a desired position. This inability to be completely and freely movable may produce disturbances in the operation of the calender, together with considerable local errors in the distributions of the linear loads. In order to eliminate the friction forces at the guides, in supercalenders, it might be possible to consider the use of the arrangement described above and commonly known from machine calenders, in which the rolls are placed on the frame of the calender by means of linkages mounted on the frame. However, the use of such an arrangement in supercalenders is limited by the fact that the set of rolls in a supercalender includes a number of fiber rolls, whose diameter may vary considerably. As a result of the variation in the diameters of the rolls, in such a case, the rolls must be able to move considerably in the vertical direction. Thus, if the rolls were attached to the frame of the calender by the linkages, the vertical shifting of the rolls would also result in a considerable shift in the transverse direction.

In view of solving the problem described above, in the assignee's Finnish Patent No. 83,346 (corresponding to U.S. Pat. No. 5,038,678, the specification of which is hereby incorporated by reference herein), an arrangement is described to eliminate the friction forces at guides and relieve the axle journal loads arising from the bearing housings of the rolls and from the auxiliary equipment in the set of rolls so as to straighten the distribution of the applied linear load. In FI 83,346, this is accomplished so that the base parts of the intermediate rolls in the stack of rolls in the calender are supported on the lifting spindles so as to be vertically displaceable by means of pressure-medium operated relief devices. The relief devices are arranged between the base parts and the spindle nuts in order to relieve the axle journal loads of the rolls. The bearing housings of the intermediate rolls are attached to the base parts pivotally in relation to an articulation shaft parallel to the axial direction of the rolls. The bearing housings are supported on the base parts and/or on the frame of the calender by means of attenuation devices so as to equalize the forces arising from the movements of the nips between the rolls and to attenuate the vibrations of the rolls.

The devices in the prior art described above involve the drawback that, in the supercalender, the nips are loaded by the gravity of the set of rolls itself, i.e., gravitational forces acting on the weight of the roll. In this case, the distribution of the linear loads from the upper nip to the lowest nip is substantially linear and increasing. This has the consequence that the linear load present in the lowest nip determines the loading capacity of the calender. Thus, the calender is dimensioned in accordance with the loading capacity of the lowest rolls. However, it is a significant drawback that at the same time, some of the loading or calendering potential of the upper nips remains unused.

FIG. 1A illustrates this lost loading or calendering potential of the upper nips. The stack of rolls in the calender is denoted with reference numeral 1. The rectangle drawn alongside the stack of rolls is denoted with reference I and illustrates the calendering potential of the calender, while the horizontal axis of the rectangle represents the linear loads in the nips in the stack of rolls 1. The shaded area in the rectangle, which is denoted with reference $A_1$, represents the range of linear loads employed in conventional embodiments. As shown in FIG. 1A, the distribution of the linear loads from the upper nip to the lowest nip is a substantially linear distribution which increases toward the lowest nip.

The range of adjustability of the linear loads is quite narrow. The designations $B_1$ and $C_1$ indicate those areas in the range of linear loads that remain fully unused in the prior art devices. Since the masses of the rolls in the set of rolls load the nips, regulation of the linear loads to the range $B_1$ is nearly impossible because high linear loads are unavoidably produced in the lower nips. Thus, it is quite difficult to conduct a running of matt grades with a conventional supercalender if the same machine is used for the production of glazed grades. On the other hand, the range $C_1$ remains unused because the calender is dimensioned in accordance with the loading capacity of the lowest rolls. Thus, as shown in FIG. 1A, a substantial proportion of the loading capacity of the upper nips remains unused.

In the past, attempts have been made to solve this considerable drawback of unused loading capacity present in the conventional prior art devices. In particular, attempts have been made to increase the deficient loading of the upper nips by placing the supercalender in the horizontal plane or by dividing the stack of rolls in the calender into two roll stacks. In the situation of a horizontal positioning of the rolls of the supercalender, slim chilled rolls and fiber rolls are used, however, it is a drawback in this embodiment that the rolls "hang" down out of the plane of the calender. Further, since the forms of the deflection lines of chilled rolls and fiber rolls are different, this "hanging" is different in comparison between adjacent rolls.

It should be stated further that rapid opening of a horizontally arranged supercalender is highly problematic. A stack of rolls divided into two parts solves the problem of incomplete loading just partially, but not entirely. Such an embodiment is also very expensive, because a calender in two parts requires a higher number of variable-crown rolls (at least 3). There are also several systems of different types based on the relief of the axle journal loads, by whose means the border line between the areas $A_1$ and $C_1$ of the calendering potential I illustrated in FIG. 1A can be made steeper. However, none of the existing systems eliminate the increase in the linear load towards the lower nip produced by the masses of the rolls in the supercalender.

OBJECTS AND SUMMARY OF THE INVENTION

It is an object of the present invention to provide a method in the calendering of a paper or an equivalent web material as well as a calender that makes use of the method, by means of which method and calender the problems arising from gravity acting on the set of rolls of the calender and appearing in the distributions of linear loads are substantially avoided.

It is another object of the present invention to provide a method in the calendering of a paper or an equivalent web material as well as a calender that makes use of the method, by means of which method and calender all the nips in the set of loads of the supercalender can be adjustably loaded in a desired manner and, if necessary, substantially with the same maximum load.

It is yet another object of the present invention to provide a new and improved method and device for calendering a paper web or equivalent web material in which the increase in the linear load toward the lower nip produced by the mass of the rolls in the calender is substantially eliminated.

It is still another object of the present invention to provide a new and improved method and device for calendering a paper web or equivalent web material in which most of the loading and calendering potential of the upper and lower calendering nips are efficiently utilized.

In view of achieving these objects, and others, the method in accordance with the present invention includes the step of using as the intermediate rolls, rolls in which the form of the natural deflection line produced by their own gravity is substantially equal. The nip load produced by the mass of the intermediate rolls and the auxiliary equipment related to the intermediate rolls is relieved substantially completely. An adjustable load is applied to the calendering nips by means of a variable-crown upper or lower roll and/or by means of an external load applied to the upper or lower roll. A variable-crown roll as known in the art, is a roll having a stationary roll axle, a revolving mantle spaced therefrom and loading members mounted on the roll axle in an interior of the roll for deflecting the mantle to thereby load the roll.

Thus, in the method for calendering a paper or a web material in a calender in the present invention, a web material to be calendered is passed through calendering nips formed by a variable-crown upper roll, a variable-crown lower roll, and by at least two intermediate rolls arranged between the upper and lower roll. The upper roll, lower roll and intermediate rolls are arranged as a substantially vertical stack. An adjustable load is applied to the calendering nips by means of at least one of the upper roll, the lower roll, an externally applied load to the upper roll and an externally applied load to the lower roll. The load in the calendering nips produced by the mass of the intermediate rolls and the mass of auxiliary equipment connected to the intermediate rolls is substantially relieved by utilizing, as the intermediate rolls, rolls in which the form of a natural deflection line produced by the weight of the rolls is substantially equal.

In a preferred embodiment, a load is applied to the calendering nips through the upper roll or lower roll and profiles of the calendering nips are maintained substantially uniform through the opposite roll. The loading profiles of the calendering nips can be regulated by means of individual, excessive or deficient relieving of the load in the calendering nips produced by the mass of each of the intermediate rolls and the mass of auxiliary equipment connected thereto.

In the calender in accordance with the present invention, intermediate rolls are selected so that the natural deflection lines produced by the gravitational forces of the intermediate rolls are substantially equal. The suspension means of the intermediate rolls are provided with relief devices, by whose means, during calendering operations, the nip loads produced by the masses of the intermediate rolls and of the auxiliary equipment related to them have been substantially relieved, and almost even completely relieved. The calendering nips are arranged so that they can be adjustably loaded by means of a load produced by a variable-crown upper roll or lower roll and/or by means of an external load applied to the upper or lower roll.

In the calender for a paper or a web material in accordance with the present invention, the calender has a frame, a variable-crown upper roll and a variable-crown lower roll arranged on the frame, and at least two intermediate rolls arranged on the frame between the upper and lower roll. The intermediate rolls have auxiliary equipment connected thereto. The upper roll, lower roll and intermediate rolls are arranged as a substantially vertical stack of rolls placed one above the other to form calendering nips with one another. Also, the intermediate rolls have substantially equal natural deflection lines produced by their own gravity. Suspension means are arranged to suspend the intermediate rolls in the stack and have relief means for relieving loads in the calendering nips produced by the mass of the intermediate rolls and the auxiliary equipment. Loading means for adjustably loading the calendering nips are provided and are selected from the group consisting of a load produced by the upper roll, a load produced by the lower roll, an external load applied to the upper roll and an external load applied to the lower roll.

In a preferred embodiment, the upper roll and lower roll are arranged to provide substantially uniform loading profiles in the calendering nips. The relief means are individually adjustable and arranged to relieve the mass of the intermediate rolls and the auxiliary equipment excessively or deficiently in order to regulate the profiles of the calendering nips. Bearing housings are connected to each of the intermediate rolls. The relief means comprises one relief device connected to each of the intermediate rolls and arranged between the frame and the bearing housing of each of the intermediate rolls or between the frame and the suspension means of the intermediate rolls.

Further advantages and characteristic features of the invention come out from the following detailed description of the invention.

By means of the invention, compared with the prior art devices, remarkable advantages are obtained. For example, by means of the method in accordance with the invention and by means of the calender that makes use of the method, substantially the entire loading or calendering potential of the roll materials can be utilized. This advantage can be realized either by substantially increasing the running speeds of the web through the calender and/or by reducing the number of nips in the calender. A reduced number of nips results in reduced costs and associated expenses. Moreover, by means of a higher calendering potential, an improved paper quality is obtained. An increased calendering potential can be utilized, for example, by substantially lowering the maximum linear loads with the resulting possibility of obtaining economies in bulk.

Further, the relief system of the roll loads in accordance with the present invention also permits an increase in the number of nips without increased linear loads, if desired, because the lowest nip is not loaded by the gravity of the set of rolls, which is the case in a normal supercalender. By means of a calender in accordance with the present invention, the adjustability of the linear loads is achieved which is substantially wider than that of conventional prior art embodiments. As such, the selection of paper grades that can be run with one and the same calender becomes considerably larger than in the prior art.

The calender may also be run in the manner of a traditional supercalender, i.e., with increasing linear loads, or inversely, i.e., with rising linear loads, in addition to invariable linear loads. In such a case, the regulation is carried out by adjusting the relief forces. The profiles of linear loads are kept substantially uniform by adjusting the deflections of the lower and upper rolls.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1A:
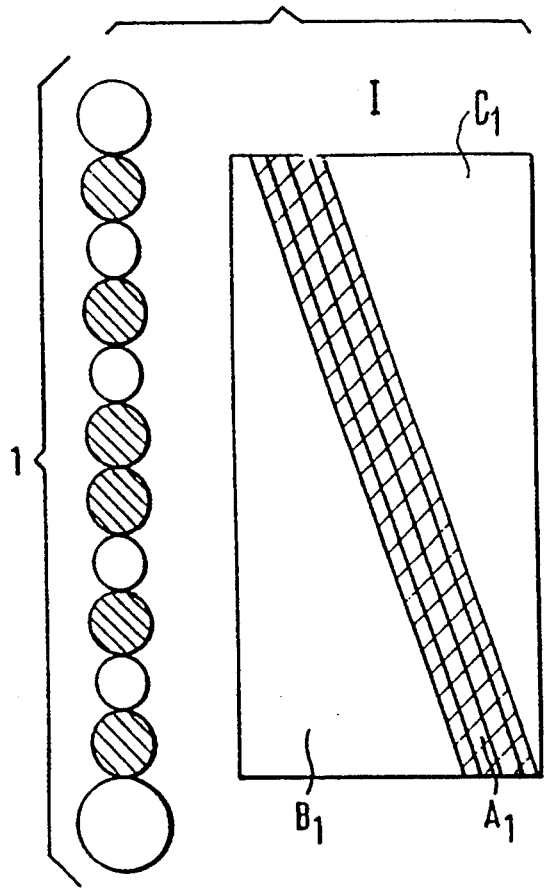
FIGS. 1A, 1B and 1C each illustrate a stack of rolls forming a calender and the calendering potential that can be utilized by means of the method and the calender in accordance with the present invention.

Referring to FIGS 1A, 1B, 1C, 2 and 3, an object of the present invention is to be able to utilize the calendering potential completely, i.e., to be able to use the entire area $A_1+B_1+C_1$ of the calendering potential I illustrated in FIG. 1A. In the present invention, this is achieved by eliminating the nip loads produced by the mass of the rolls in the stack of rolls 1 so that all the nips in the calender can be loaded with the desired load, e.g., equal in all the nips.

In order that the same maximum load be used in all the nips in the calender, in the method of the present invention and in the calender that makes use of the method, the natural deflections of the rolls in the stack of rolls are utilized. In such a case, in the calender, the form of an individual nip is a curve equal to the deflection line produced by the gravity of the rolls. This requires that, in the calender, the deflection lines produced by the gravity of each intermediate roll must be dimensioned so that their forms are substantially equal.

Figure 3:
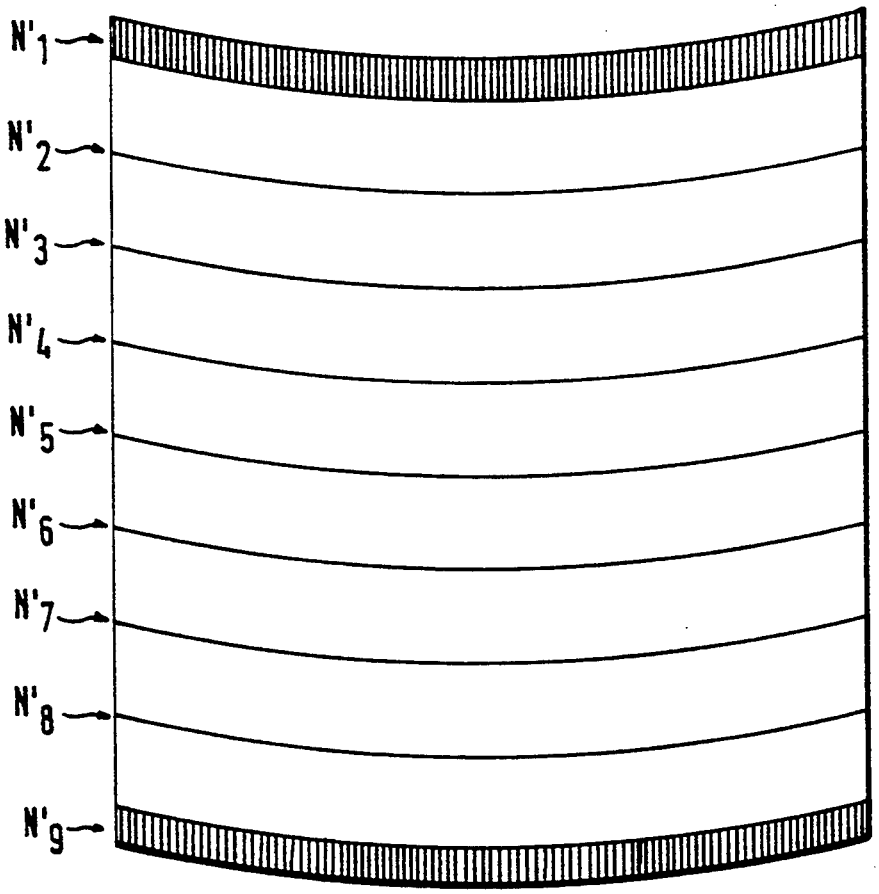
FIG. 3 is a fully schematic illustration of a calender in accordance with the present invention, in which the form of the deflection lines of the rolls is substantially equal.

As shown in FIG. 3 in particular, the upper and lower nips of the calender are denoted with the references $N'_1$ and $N'_9$, and the nips between the intermediate rolls in the calender with references $N'_2, \ldots, N'_8$. The loading profiles imparted by each nip $N'_1, \ldots, N'_9$ to the paper web are retained substantially uniform in spite of the fact that the rolls that load the nip are supported from their ends. In the prior art, attempts were made to keep the calender nips as straight as possible. However, as described with respect to the present invention, a curved form of the nips is not detrimental in calendering because, for example, with a web width of about 8000 mm and with a roll diameter of about 1000 mm, the maximum deflection produced by the gravity of the rolls is just of an order of about 0.2 mm.

In a supercalender, the invariable load is applied to the calender by means of a variable-crown roll acting as the upper roll and/or by means of an external load applied to the upper roll. In order to keep the profiles even, in the stack of rolls, a variable-crown roll is also used as the lowest roll.

In the past, the use of an embodiment in accordance with the present invention has not been considered at all. One of the reasons for this is that, especially in supercalenders, the natural deflection lines of the intermediate rolls have differed from one another substantially. In the stack of rolls in a supercalender, chilled rolls and fiber rolls, whose deflections and rigidities are different, are used alternatingly. Compared with a chilled roll, the body of a fiber roll is quite slim. The development of rolls and roll coatings has introduced the possibility that, in supercalenders, polymer-coated rolls can be used as soft rolls instead of fiber rolls. In polymer-coated rolls, the thickness of the coating in relation to the diameter of the roll is quite small, in which case the roll body can be made quite rigid. Thus, especially when polymer-coated rolls are used, it is possible to construct the rolls so that the natural deflection lines of all of the intermediate rolls in a calender become substantially equal. In such a case, the form of each nip $N'_1, \ldots, N'_9$ in the stack of rolls in a calender is substantially equal, as shown in FIG. 3, whereby the nips have substantially uniform profiles.

Figure 2:
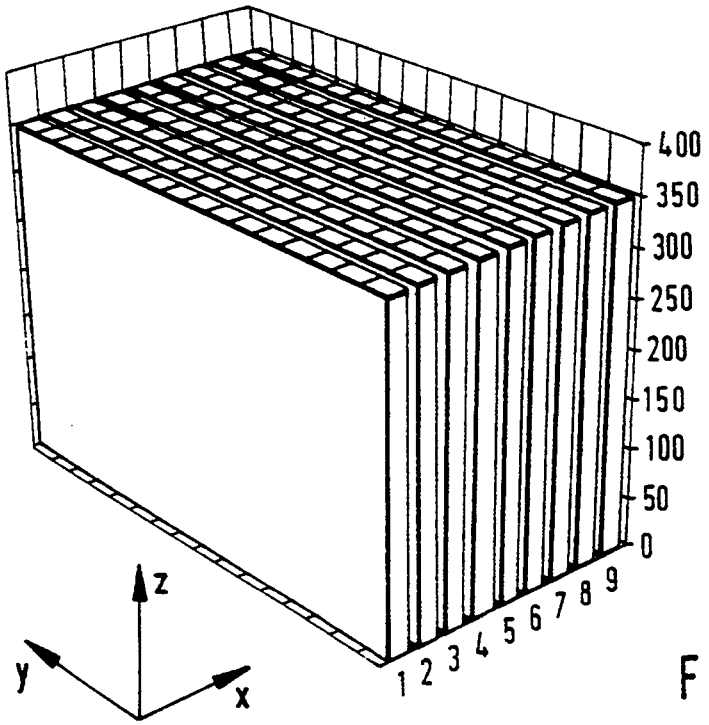
FIG. 2 is a fully schematic illustration of a uniform loading with invariable nip loads in the nips in the calender, which can be achieved by the present invention.

FIG. 2 is a schematic perspective view of the present invention illustrating the possibility of obtaining an equally high uniform load in all of the nips in the calender. On the x-axis in the system of coordinates, the nips are represented (1–9), the y-axis represents the transverse direction of the machine, and the z-axis gives an example of the linear loads [kN/m].

Besides the circumstance that the natural deflection lines of the intermediate rolls in the stack of rolls should be substantially equal, in the present invention it is also important and significant that the rigidities of the intermediate rolls should also be the same, or at least very close to one another. In this manner, a significant advantage is obtained in that the profiles of the calendering nips remain good and uniform in the entire area $A_1+B_1+C_1$ of the calendering potential shown in FIG. 1A. As the present invention is at least partially based on the fact that the loads produced by the roll weights and by the auxiliary equipment are substantially relieved, and almost even completely relieved, if the intermediate rolls have equal rigidities, it is possible to correct the profiles of the nips in every nip. This correction of the profile is carried out by relieving the weight of the rolls and the weight of the auxiliary equipment either excessively or deficiently. With the possibility of correcting the profile in each nip, the service lives of the roll coatings can be increased, because a correction need not be carried out in one nip in the stack of rolls only, which is the case in existing calenders.

Figure 1B:
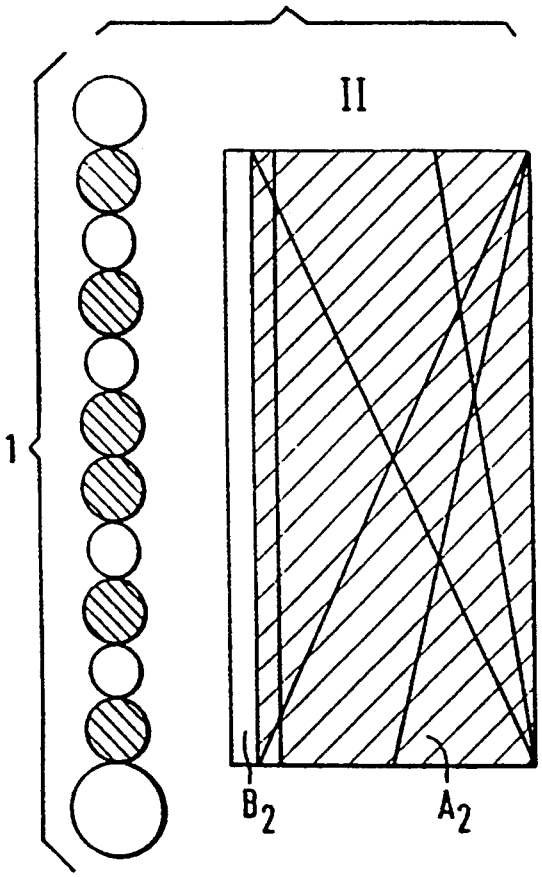

Since the weights of the intermediate rolls and the related auxiliary equipment can be relieved excessively or deficiently as desired, the entire calendering potential can be utilized in the desired manner, as illustrated in section II of FIG. 1B. The shaded area $A_2$ in the calendering potential II represents the available calendering potential. The small unshaded area $B_2$, in which the linear loads cannot be adjusted, arises from the construction of the calender, such as friction. In the shaded area $A_2$, lines have been drawn that pass across the area to different corners. These lines illustrate that, in addition to invariable linear loads of different levels, all possible linear increasing and decreasing alternatives of loading are available.

Figure 1C:
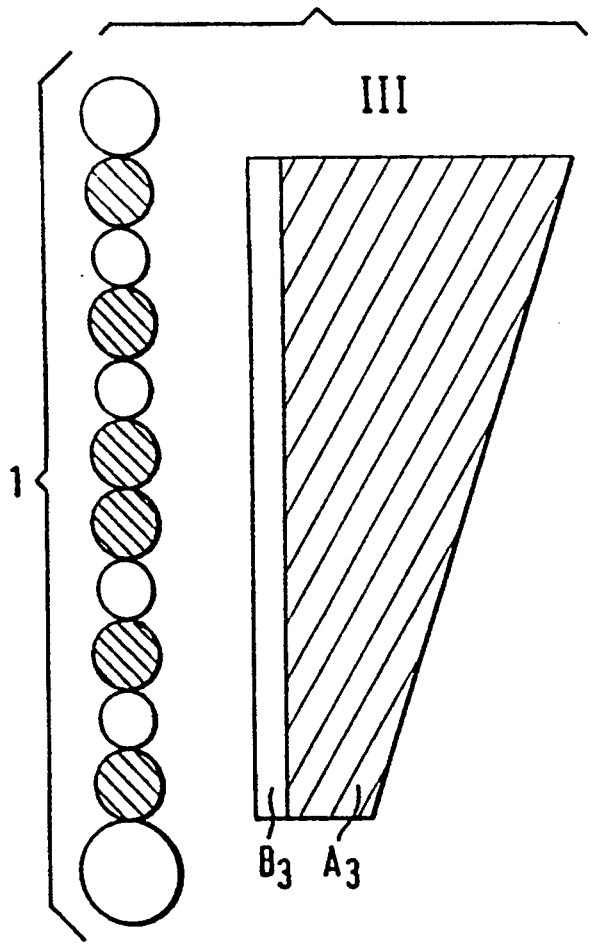

In section III of FIG. 1C, a situation is illustrated in which the load is applied to the stack of rolls from below and the intermediate rolls are relieved excessively so that, in the upper nips, the excessive relief is higher than in the lower nips.

If polymer-coated rolls are used as the soft rolls in the calender, in the heatable chilled rolls it is possible to use higher temperatures than in prior art methods and devices, e.g., by means of suitable internal or external heating means. In the method and calender which uses the method in accordance with the present invention, it is also possible to use prior art fiber rolls as the soft rolls if the bodies of the fiber rolls can be made sufficiently rigid. If polymer-coated rolls are used as the soft rolls, it is possible to form these polymer-coated rolls as cooling rolls, e.g., by suitable internal or external cooling means, for example, by providing the bodies of these rolls with bores or with equivalent ducts for circulation of a cooling medium. In such an embodiment, the service life of the coating can be increased and, moreover, for this reason, the temperatures in the heated chilled rolls can be raised. This has a significant effect with respect to an improved calendering result.

Figure 4:
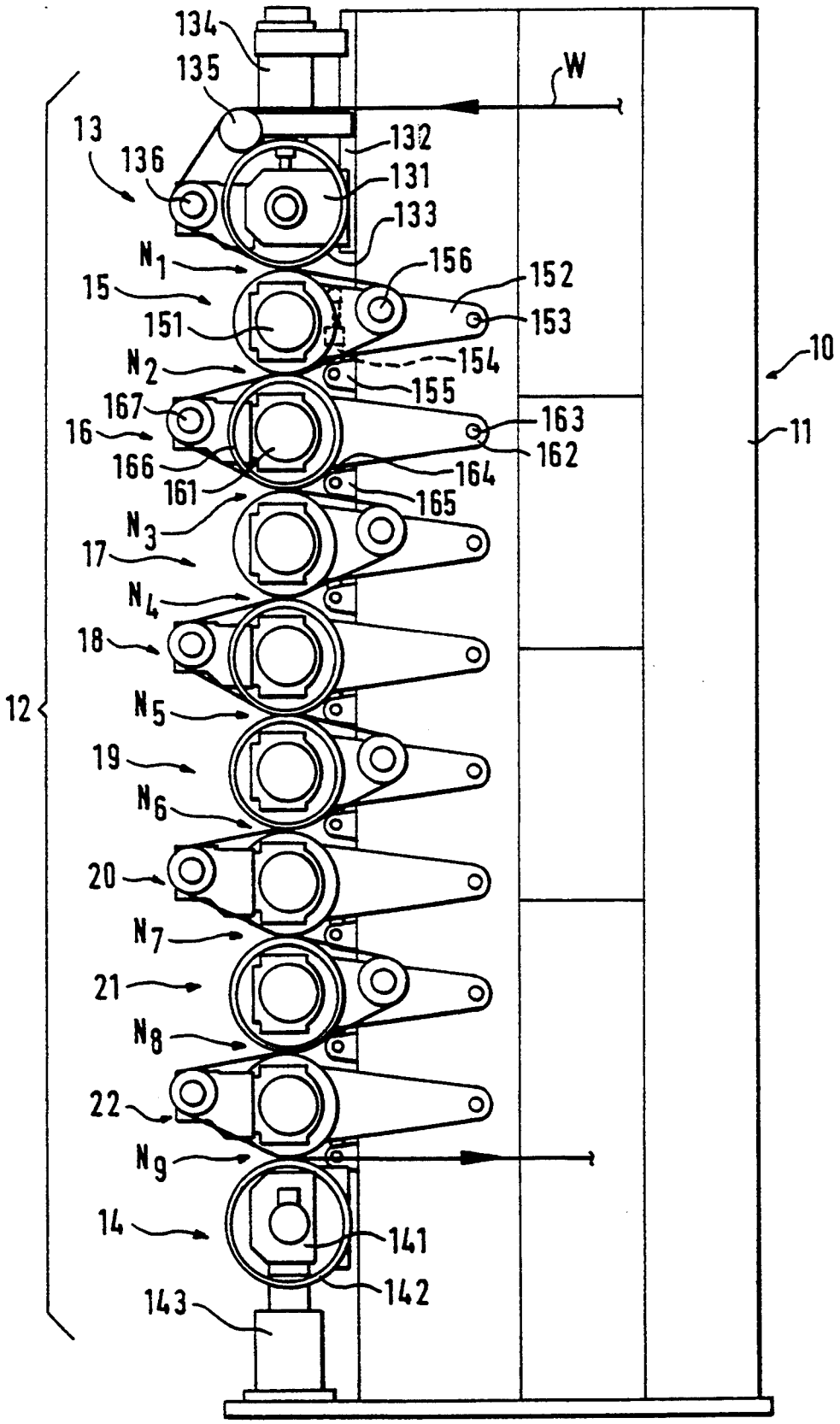
FIG. 4 is a schematic side view of a calender in which the method and the system in accordance with the present invention are applied.

FIG. 4 is a schematic side view of a supercalender in which the method in accordance with the present invention is applied. In FIG. 4, the supercalender is denoted generally with reference numeral 10, and it includes a calender frame 11, in which a stack of rolls 12 consisting of a number of rolls is mounted in a vertical plane. The stack of rolls 12 comprises an upper roll 13, a lower roll 14, and a number intermediate rolls 15, . . . ,22 arranged one above the other between the upper roll and the lower roll. The rolls are arranged so that they are in nip contact with one another to form calendering nips. The paper web W is passed over a spreader roll 135 and a take-out leading roll 136 into the upper nip $N_1$ and further through the other nips $N_2, \ldots, N_8$ in the calender and finally out from the lower nip $N_9$. At the gaps between the nips $N_1, \ldots, N_9$, the paper web W is taken apart from the roll faces by means of take-out leader rolls 156,167.

The upper roll 13 in the calender is a variable-crown roll, and it is arranged in connection with an upper cylinder 134 placed at each end of the roll and attached to the frame 11 of the calender. A piston in the cylinder 134 acts upon a bearing housing 131 of the upper roll. The axle of the variable-crown upper roll 13 is mounted in the bearing housing 131, and the roll is conventionally provided with inside or interior loading means, by which the deflection of the roll mantle can be regulated in the desired manner. Vertical guides 132 are formed on the frame 11 of the calender, on which the bearing housings 131 are arranged so as to be displaceable. Bearing housings 131 can be displaced by means of the upper cylinders 134 along vertical guides 132.

In the embodiment in accordance with the present invention, the upper cylinders 134 need not necessarily be used for loading the stack of rolls 12. Rather, in such a case, the upper cylinders 134 are used for closing and opening the upper nip $N_1$. It is, however, also possible to use the upper cylinders 134 for loading the stack of rolls 12, either alone or together with the inside loading means in the variable-crown upper roll 13. The loading proper of the nips $N_1, \ldots, N_9$ in the stack of rolls 12 can also be arranged exclusively by means of the inside loading means in the variable-crown upper roll 13 or lower roll 14. In the embodiment as shown in FIG. 4, the upper roll 13 is provided with a resilient polymer coating, i.e., on an outer surface or face thereof.

Similarly, the lower roll 14 in the calender is a variable-crown roll, whose roll mantle is mounted revolvingly on the roll axle. Roll 14 includes inside or interior loading means for regulating the deflection of the roll mantle in a desired manner. The axle of the lower roll 14 is mounted in bearing housings 141 which can be displaced in the vertical plane by means of lower cylinders 143. Thus, by means of the lower cylinders 143, the stack of rolls 12 can be opened in the conventional way. Owing to the variable-crown lower roll 14, the profiles of linear loads can be kept substantially uniform in the nips $N_1, \ldots, N_9$ in the stack of rolls 12. In FIG. 4, the lower roll is provided with a resilient polymer coating 142, in a similar manner as the upper roll 13 has such a polymer coating.

As described above, between the upper roll 13 and the lower roll 14, a number of intermediate rolls 15, . . . ,22 are arranged which are in nip contact with one another. In the following description, the uppermost two intermediate rolls 15,16 will be described in more detail. In the illustrated embodiment, the uppermost intermediate roll 15 is a hard-faced roll, whose ends are mounted revolvingly in bearing housings 151. Bearing housings 151 are mounted on arms 152 which are linked pivotally on the calender frame 11 by means of articulated joints 153 positioned parallel to the axis of the roll 15. The assembly of the bearing housings 151, arms 152 and articulated joints 153 constitute suspension means for suspending the intermediate rolls in the stack.

The arms 152 are provided with relief devices 154, or other suitable relief means, which are, in the embodiment shown in FIG. 4, pressure-medium operated piston-cylinder devices, one of whose ends is attached to the arms 152 and the opposite end to brackets 155 mounted on the frame 11 of the calender. The piston-cylinder devices 154 may be, e.g., hydraulic or pneumatic cylinders or equivalent.

The second-highest intermediate roll 16 in the stack 12 is a soft-faced roll, which is, in the exemplifying embodiment shown, provided with a resilient polymer coating 166. The roll 16 is mounted by its ends to revolve in bearing housings 161 which are mounted on respective arms 162. The arms 162 are linked pivotally on the calender frame 11 by means of articulated joints 163 positioned parallel to the axial direction of the roll 16. Further, the arms 162 are provided with relief devices, for example with pressure-medium operated piston-cylinder devices 164, one of whose ends is attached to the arms 162 and the opposite end to the brackets 165 mounted on the calender frame 11. Further, the bearing housings of take-out leading roll 167 are attached to the bearing housings 161 of the second-highest intermediate roll 16.

The support structure of the other intermediate rolls 17, . . . , 22 is not denoted in detail with reference characters in FIG. 4, but, as can be seen from FIG. 4, the support of these rolls 17, . . . ,22 is similar to that described with respect to roll 15,16. In a preferred embodiment, the hard-faced rolls alternate with the soft-faced rolls so that intermediate rolls 15, 17, 20 and 22 are hard-faced rolls and intermediate rolls 16, 18, 19 and 21 are soft-faced rolls.

By means of the relief devices 154,164, a relief force is applied to the support constructions of the rolls 15,16. The relief force compensates for substantially the entire loads produced by the weight of the rolls and the weight of the auxiliary equipment 167 attached to the rolls. Thus, the weight of the rolls and of the auxiliary equipment has no increasing effect whatsoever on the nip loads. In each nip $N_1, \ldots, N_9$, if desired, the linear load can be made substantially equally high, in which case the profiles of the nip loads are similar to those shown in FIG. 2. This emanates from the fact that an invariable load is applied to the calender by means of the variable-crown roll that is used as the upper roll 13.

In connection with the description of FIG. 4, it was stated that the intermediate rolls in the stack of rolls 12 consist of alternating hard-faced and soft-faced rolls. It is, however, fully possible that all the rolls in the stack of rolls 12 are hard-faced rolls and that the number of the intermediate rolls is substantially lower than that shown in FIG. 4. In such a case, the calender shown in FIG. 4 can be used, for example, as a machine calender. In this embodiment, the number of intermediate rolls must be generally at least two. It is also completely obvious that the number of intermediate rolls may be even substantially higher than that shown in FIG. 4.

In a manner similar to a normal construction known from supercalenders, the hard-faced rolls 15,17,20,22 can be arranged to be heatable, e.g. in connection with heating means. It is also possible that only the uppermost hard rolls 15,17 are heated, the heat being transferred along with the web W to the lower nips $N_5, \ldots, N_9$.

Figure 5:
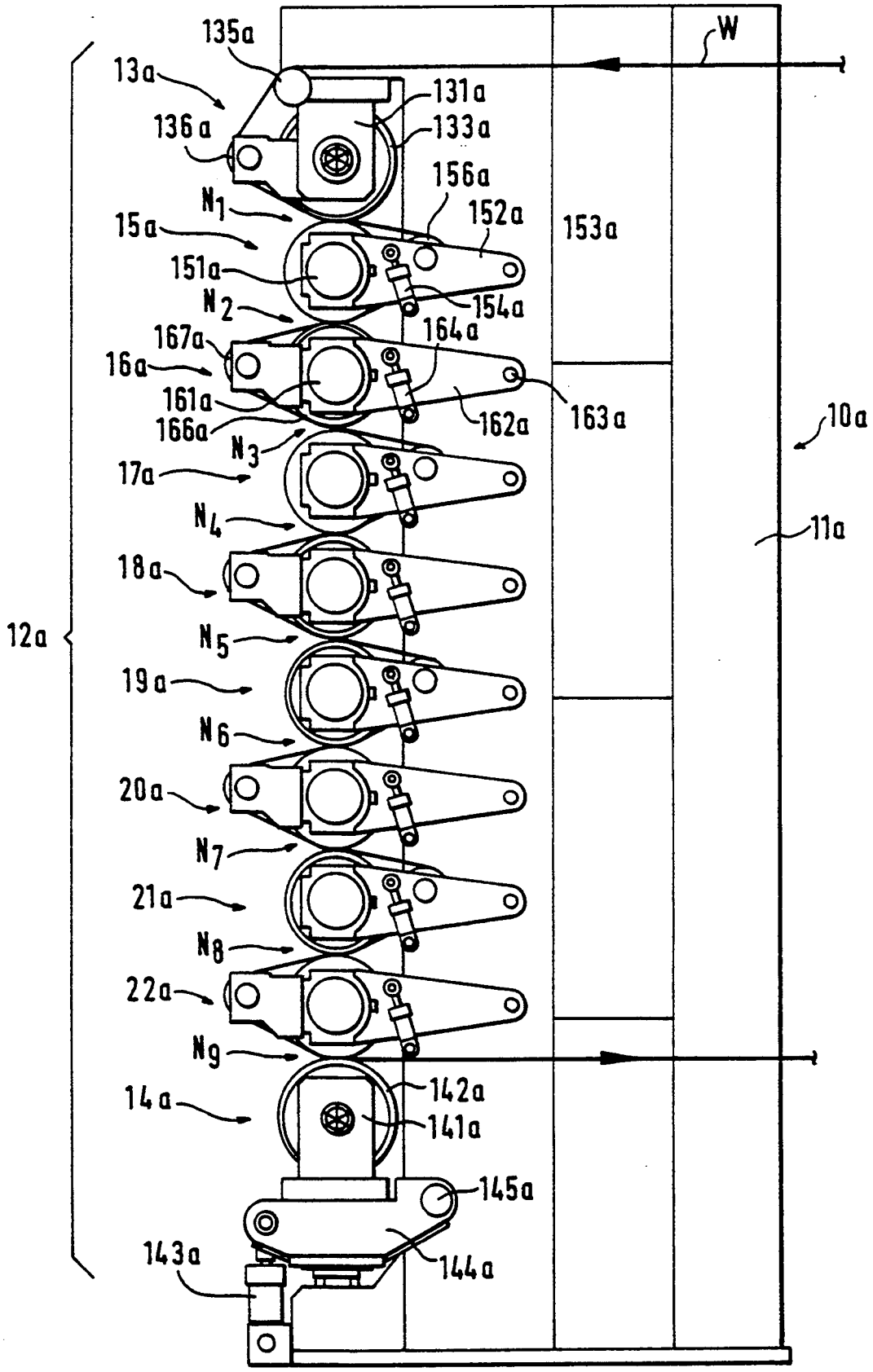
FIG. 5 is an illustration corresponding to FIG. 4 of an alternative embodiment of a calender that makes use of the method and the system of the present invention.

FIG. 5 shows an illustration corresponding to FIG. 4 of a second supercalender that makes use of the method of the present invention. In FIG. 5, the supercalender is denoted generally with reference numeral 10*a*, and has a calender frame 11*a* on which a stack of rolls 12*a* consisting of a number of rolls is mounted in the vertical plane. The stack of rolls 12*a* includes an upper roll 13*a*, a lower roll 14*a*, and a number of intermediate rolls 15*a*, . . . ,22*a* placed in an arrangement one above the other between the upper roll and the lower roll. The rolls are arranged so that they are in nip contact with one another. The paper web W is passed over a spreader roll 135*a* and a take-out leading roll 136*a* into the upper nip $N_1$ and further through the other nips $N_2, \ldots, N_8$ in the calender and finally out from the lower nip $N_9$. At the gaps between the nips $N_1, \ldots, N_{90}$, the paper web W is taken apart from the roll faces by means of takeout leading rolls 156*a*,167*a*.

In the embodiment of FIG. 5, the upper roll 13*a* in the calender is a variable-crown roll, whose bearing housing 131*a* is, differing from the embodiment shown in FIG. 4, attached directly and rigidly to the frame 11*a* of the calender. The axle of the variable-crown upper roll 13*a* is mounted in the bearing housing 131*a*, and the roll is conventionally provided with inside loading means, by which the deflection of the roll mantle can be regulated in the desired manner.

The lower roll 14*a* in the calender is a variable-crown roll whose roll mantle is mounted revolvingly on the roll axle. Roll 14*a* is provided with inside loading means, or interior loading means, by which the deflection of the roll mantle can be regulated in the desired way. The axle of the lower roll 14*a* is mounted in bearing housings 141*a*, which are, differing from the embodiment shown in FIG. 4, mounted on loading arms 144*a*. Loading arms 144*a* are linked by means of articulated joints 145*a* to the calender frame 11*a*. Between the calender frame 11*a* and the loading arms 144*a*, lower cylinders 143*a* are mounted, by whose means the lower roll 14*a* can be displaced in the vertical direction. In the embodiment shown in FIG. 5, the stack of rolls 12*a* can be loaded by means of the lower cylinders 143*a*. Moreover, by means of lower cylinders 143*a*, the stack of rolls 12*a* can be opened. Owing to the variable-crown lower roll 14*a*, the profiles of linear loads can be kept substantially uniform in the nips $N_1, \ldots, N_9$ in the stack of rolls 12*a*. In the embodiment of FIG. 5, the lower roll 14*a* is also provided with a resilient polymer coating 142*a*.

Intermediate rolls 15*a*, . . . ,22*a* in the stack of rolls 12*a* are substantially similar to those described in connection with the embodiment of FIG. 4. In the embodiment of FIG. 5, the uppermost intermediate roll 15*a* is a hard-faced roll which is mounted by its ends revolvingly in the bearing housings 151*a*. The bearing housings 151*a* are mounted on arms 152*a* which are linked pivotally on the calender frame 11*a* by means of articulated joints 153*a* situated parallel to the axial direction of the roll 15*a*. The arms 152*a* are provided with relief devices 154*a*, which are, also in the embodiment of FIG. 5, pressure-medium operated piston-cylinder devices. Devices 154*a* are attached at one end to arms 152*a* and, by an opposite end, to the calender frame 11*a*. The piston-cylinder devices 154*a* may be hydraulic or pneumatic cylinders or equivalent.

In the embodiment of FIG. 5, the second-highest intermediate roll 16*a* is a soft-faced roll, which is provided with a resilient polymer coating 166*a*. Roll 16*a* is mounted by its ends revolvingly in the bearing housings 161*a* which are mounted on respective arms 162*a*. The arms 162*a* are linked pivotally on the calender frame 11*a* by means of articulated joints 163*a* parallel to the axial direction of the roll 16*a*. The arms 162*a* are provided with relief devices, for example pressure-medium operated piston-cylinder devices 164*a*. Devices 164*a* are attached at one end thereof to arms 162*a* and, by an opposite end, to the calender frame 11*a*. Further, the bearing housings of the take-out leading roll 167*a* are attached to the bearing housings 161*a* of the second highest intermediate roll 16*a*.

Even through the support of the other intermediate rolls is not indicated in detail in FIG. 5, it can, however, be seen clearly from the figure that the support of these rolls 17*a*, . . . ,22*a* is similar to that described above with respect to rolls 15*a* and 16*a*.

The intermediate rolls 15*a*, . . . ,22*a* in the stack of rolls 12*a* consist of alternating hard-faced and soft-faced rolls, as described with respect to the embodiment of FIG. 4. However, it is also possible to form the stack of rolls 12*a* exclusively from hard rolls. It is also possible to provide the hard rolls with heating means, either so that all the hard rolls 15*a*,17*a*,20*a*,22*a* in the stack of rolls 12*a* are heatable rolls, or alternatively, only the upper hard rolls 15*a*, 17*a* in the stack of rolls 12*a* may be arranged to be heatable. If necessary, the polymer-faced soft rolls 16*a*,18*a*,19*a*,21*a* can be provided with cooling means. By means of a calender as shown in FIG. 5, it is possible, if desired, to provide such a regulation of the linear loads as shown in section III in FIG. 1C.

The embodiments shown in FIGS. 4 and 5 are some examples of the application of the relief force to the intermediate rolls 15, . . . ,22, 15*a*, . . . ,22*a* in the stack of rolls 12,12*a* by means of the relief devices 154,164,154*a*,164*a*. Numerous other embodiments for applying the relief force are also possible, and FIGS. 6A, 6B, 6C, and 6D illustrate some alternative embodiments for the introduction of the relief force.

Figure 6A:
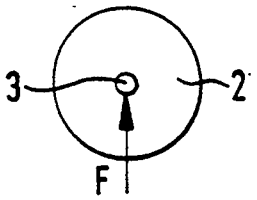
FIGS. 6A, 6B, 6C and 6D illustrate alternative exemplifying embodiments of the ways in which the relief force can be applied to the rolls in the calender.

FIG. 6A shows an exemplifying embodiment of the present invention in which the relief force, denoted with an arrow and with a reference F in FIG. 6A, is applied directly to the bearing housing 3 of the roll 2.

Figure 6B:
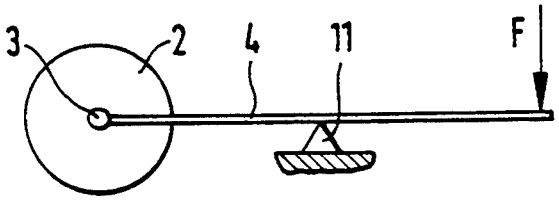

In the exemplifying embodiment of the present invention shown in FIG. 6B, the bearing housing 3 of the roll 2 is mounted on a rocker arm 4, which is mounted on the frame 11 of the calender. In this embodiment, the relief force F is applied to the rocker arm 4 at the opposite side of the articulation point of the rocker arm, opposite in relation to the roll 2. In this case, the relief force F is, of course, of a direction opposite to that shown in FIG. 6A.

Figure 6C:
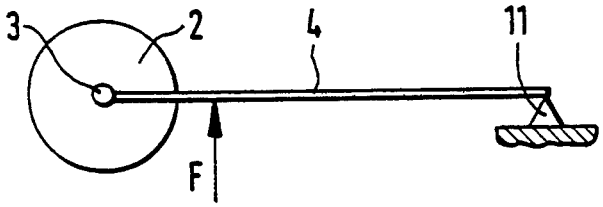

The exemplifying embodiment of the present invention shown in FIG. 6C corresponds to the embodiment shown in FIGS. 4 and 5 so that the relief force F is applied to the rocker arm 4 in the area between the bearing housing 3 of the roll 2 and the journalling point of the rocker arm 4 on the calender frame 11.

Figure 6D:
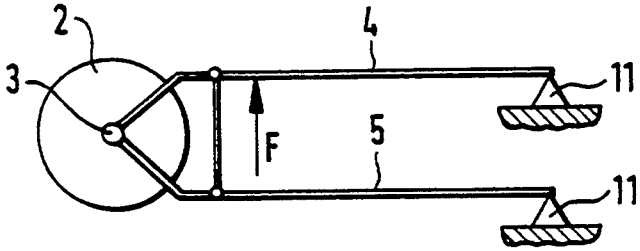

FIG. 6D shows another exemplifying embodiment of the present invention in which the relief force F is applied to the roll 2 quite far in the same way as is shown in FIG. 6C. In the embodiment of FIG. 6D, the support of the roll 2 is, however, arranged by means of a linkage, which comprises a parallel linkage 4,5. Owing to the parallel linkage 4,5, when the roll 2 is raised and lowered, the position of the bearing housing 3 of the roll 2 is not changed during the movement.

Other sorts of modes of support and modes of relief are also possible in the method in accordance with the present invention and in the calender that makes use of the method. It is, however, important that the loads arising from the weight of the whole roll and the weight of the related auxiliary equipment are compensated for by means of relief forces F.

The examples provided above are not meant to be exclusive. Many other variations of the present invention would be obvious to those skilled in the art, and are contemplated to be within the scope of the appended claims.

What is claimed is:

1. A method for calendering a web in a calender, wherein the web to be calendered is passed through calendering nips formed by a variable-crown upper roll, a variable-crown lower roll, each of said upper and lower rolls having a stationary roll axle, a revolving mantle spaced therefrom and loading members coupled to said roll axle for deflecting said mantle to load said roll, and by at least two intermediate rolls arranged between said upper roll and lower roll, said intermediate rolls having auxiliary equipment connected thereto, said upper roll, said lower roll and said intermediate rolls being arranged as a substantially vertical stack, comprising the steps of:

applying an adjustable load to the calendering nips by means of at least one of said loading members of said upper roll, said loading members of said lower roll, an externally applied load to said upper roll and an externally applied load to said lower roll, and relieving the load in the calendering nips produced by the mass of said intermediate rolls and the mass of the auxiliary equipment connected to said intermediate rolls by utilizing, as said intermediate rolls, rolls in which the form of a natural deflection line produced by the weight of said rolls is substantially equal.

2. The method of claim 1, wherein said intermediate rolls comprise hard rolls and soft-faced rolls.

3. The method of claim 2, wherein said soft-faced intermediate rolls comprise rolls having a resilient polymer coating.

4. The method of claim 2, wherein said soft-faced intermediate rolls comprise fiber rolls having a rigid roll body.

5. The method of claim 2, further comprising the step of heating at least one of said hard intermediate rolls.

6. The method of claim 2, further comprising the step of cooling said soft-faced intermediate rolls during calendering.

7. The method of claim 1, wherein said intermediate rolls are only hard rolls.

8. The method of claim 1, further comprising the steps of applying a load to the calendering nips through said upper roll and maintaining profiles of the calendering nips substantially uniform through said lower roll.

9. The method of claim 1, further comprising the steps of applying a load to the calendering nips through said lower roll, and maintaining profiles of the calendering nips substantially uniform through said upper roll.

10. The method of claim 1, further comprising the step of providing the intermediate rolls with a degree of rigidity at least substantially close to one another.

11. The method of claim 1, further comprising the step of regulating loading profiles of the calendering nips by means of individual, excessive or deficient relieving of the load in the calendering nips produced by the mass of each of said intermediate rolls and the mass of auxiliary equipment connected to said intermediate rolls.

12. Calender that makes use of the method as claimed in claim 1.

13. A method for calendering a web in a calender, comprising the steps of:

arranging a variable-crown upper roll and a variable-crown lower roll in a vertical plane, each of said upper and lower rolls having a stationary roll axle, a revolving mantle spaced therefrom and loading members coupled to said roll axle for deflecting said mantle to load said roll, arranging intermediate rolls in a stack between said upper roll and said lower roll to form calendering nips, said intermediate rolls having auxiliary equipment connected thereto, passing a web to be calendered through the calendering nips, applying an adjustable load to the calendering nips by means of at least one of said loading members of said upper roll, said loading members of said lower roll, an externally applied load to said upper roll and an externally applied load to said lower roll, and relieving the load in the calendering nips produced by the mass of said intermediate rolls and auxiliary equipment connected thereto by utilizing, as said intermediate rolls, rolls in which the form of a natural deflection line produced by the weight of said rolls is substantially equal.

14. Calender for a web, comprising a frame, a variable-crown upper roll arranged on said frame, said upper roll having a stationary roll axle, a revolving mantle spaced therefrom and loading members connected to said roll axle for deflecting said mantle to load said upper roll, a variable-crown lower roll arranged on said frame, said lower roll having a stationary roll axle, a revolving mantle spaced therefrom and loading members coupled to said roll axle for deflecting said mantle to load said lower roll, at least two intermediate rolls arranged on said frame between said upper roll and said lower roll, said intermediate rolls having auxiliary equipment connected thereto, said upper roll, said lower roll and said intermediate rolls being arranged as a substantially vertical stack of rolls placed one above the other to form calendering nips with one another through which the web is passed, said intermediate rolls having substantially equal natural deflection lines produced by their own gravity, suspension means for suspending said intermediate rolls in the stack, said suspension means comprising relief means for relieving loads in the calendering nips produced by the mass of said intermediate rolls and the auxiliary equipment, and loading means for adjustably loading the calendering nips, said loading means being selected from the group consisting of a load produced by said loading members of said upper roll, a load produced by said loading members of said lower roll, an external load applied to said upper roll and an external load applied to said lower roll.

15. The calender of claim 14, wherein said intermediate rolls are selected from the group consisting of hard rolls and soft-faced rolls.

16. The calender of claim 15, wherein said soft-faced rolls have a resilient polymer coating.

17. The calender of claim 15, wherein said soft-faced rolls are fiber rolls having a rigid roll body.

18. The calender of claim 15, wherein at least one of said hard rolls is a heatable roll.

19. The calender of claim 15, wherein said soft-faced rolls are cooling rolls.

20. The calender of claim 14, wherein said upper roll, said lower roll and said intermediate rolls are hard rolls.

21. The calender of claim 14, wherein said upper roll and said lower roll are arranged to provide substantially uniform loading profiles in the calendering nips.

22. The calender of claim 14, wherein the rigidities of said intermediate rolls are at least substantially close to one another.

23. The calender of claim 14, wherein said relief means are individually adjustable and arranged to relieve the mass of said intermediate rolls and the auxiliary equipment excessively or deficiently in order to regulate the profiles of the calendering nips.

24. The calender of claim 23, further comprising bearing housings connected to each of said intermediate rolls, said relief means comprising one relief device connected to each of said intermediate rolls and being arranged between said frame and said bearing housing of each of said intermediate rolls.

25. The calender of claim 23, wherein said relief means comprise pressure-medium operated piston-cylinder devices.

26. The calender of claim 23, further comprising bearing housings connected to each of said intermediate rolls, said relief means comprising one relief device connected to each of said intermediate rolls and being arranged between said frame and said suspension means of said intermediate rolls.

* * * * *